US008714210B2

(12) United States Patent
Ashrafzadeh et al.

(10) Patent No.: US 8,714,210 B2
(45) **Date of Patent: *May 6, 2014**

(54) SELECT-FILL DISPENSING SYSTEM

(75) Inventors: Farhad Ashrafzadeh, Stevensville, MI (US); Kevin M. Chase, Saint Joseph, MI (US); Brian P. Janke, Saint Joseph, MI (US); Shreecharan Kanchanavally, Lisle, IL (US); Ronald L. Voglewede, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/613,619

(22) Filed: Sep. 13, 2012

(65) Prior Publication Data

US 2013/0008556 A1 Jan. 10, 2013

Related U.S. Application Data

(63) Continuation of application No. 12/718,192, filed on Mar. 5, 2010, now Pat. No. 8,322,384.

(51) Int. Cl.
*B65B 1/30* (2006.01)
*B67D 1/12* (2006.01)

(52) U.S. Cl.
CPC ..... *B67D 1/1238* (2013.01)
USPC ..... 141/95; 141/2; 141/94; 141/192; 141/198; 62/389

(58) Field of Classification Search
USPC ..... 141/1, 95, 141, 198, 351, 360; 62/126, 62/177, 389; 222/1, 52
See application file for complete search history.

(56) References Cited

U.S. PATENT DOCUMENTS

| | | | | |
|---|---|---|---|---|
| 5,862,844 | A * | 1/1999 | Perrin | 141/351 |
| 6,394,153 | B2 * | 5/2002 | Skell et al. | 141/351 |
| 6,705,356 | B2 * | 3/2004 | Barton et al. | 141/2 |
| 6,789,585 | B1 * | 9/2004 | Janke | 141/198 |
| 7,201,005 | B2 * | 4/2007 | Voglewede et al. | 62/126 |

(Continued)

FOREIGN PATENT DOCUMENTS

EP 1607700 A2 12/2005

OTHER PUBLICATIONS

European Patent Application No. 11157197.2 filed Mar. 7, 2011. European Search No. EP2365264A3, published 20 Feb. 2013. Applicant: Whirlpool.

(Continued)

*Primary Examiner* — Timothy L Maust

(57) ABSTRACT

A select-fill dispensing system and method for a dispenser assembly utilizes a camera to sense a desired fill level based on the location of a user's finger with respect to a container. In use, a consumer places his or her finger along a container to indicate the desired fill level of the container. Image data from the camera is transmitted to a controller and processed for distortion correction, edge based image segmentation and morphological operations are carried out to remove background noise. The processed image data is utilized to detect the presence of the container, as well as the shape of the container, the position of the container opening, and the top and bottom points of the container. The controller provides a means for controlling the dispensing operation, including a fill rate, based on the desired fill level and the shape of the container.

18 Claims, 4 Drawing Sheets

(56) References Cited

U.S. PATENT DOCUMENTS

| | | | | |
|---|---|---|---|---|
| 7,546,854 | B2 * | 6/2009 | Ozanne et al. | 141/198 |
| 7,673,661 | B2 * | 3/2010 | Chase et al. | 141/360 |
| 7,743,801 | B2 * | 6/2010 | Janardhanam et al. | 141/351 |
| 8,109,301 | B1 * | 2/2012 | Denise | 141/360 |
| 8,151,596 | B2 * | 4/2012 | Richmond et al. | 62/391 |
| 8,245,735 | B2 * | 8/2012 | Chase et al. | 141/1 |
| 8,322,384 | B2 * | 12/2012 | Ashrafzadeh et al. | 141/198 |
| 8,353,321 | B2 * | 1/2013 | Agam et al. | 141/198 |
| 8,364,321 | B2 * | 1/2013 | Kollep | 700/283 |
| 2008/0006042 | A1 | 1/2008 | Lee | |
| 2008/0156395 | A1 | 7/2008 | Janardhanam et al. | |
| 2008/0264092 | A1 | 10/2008 | Chase et al. | |
| 2009/0183796 | A1 | 7/2009 | Chase et al. | |
| 2009/0314801 | A1 | 12/2009 | Ashrafzadeh et al. | |

OTHER PUBLICATIONS

European Patent Application No. 11155217.0 filed Feb. 21, 2011, Applicant: Whirlpool Europe, S.r.1, European search report re: same, mail date: Dec. 16, 2013.

* cited by examiner

SELECT-FILL DISPENSING SYSTEM

CROSS-REFERENCE TO RELATED APPLICATIONS

The present application represents a continuation application of U.S. patent application Ser. No. 12/718,192 entitled "Select-Fill Dispensing System" filed Mar. 5, 2010, now U.S. Pat. No. 8,322,384.

BACKGROUND OF THE INVENTION

1. Field of the Invention

The present invention pertains to the art of product dispensers and, more particularly, to a select-fill dispensing system and method for a dispenser, such as a door-mounted refrigerator dispenser.

2. Description of the Related Art

Refrigerators having built-in ice/water dispensers are well known in the art. In general, the dispensers are mounted to a door of the refrigerator for the purpose of dispensing ice and/or water without requiring a user to access a refrigerator compartment. A typical dispenser includes a dispenser well into which a container is placed. Once the container is in position, an actuator is operated to release the ice and/or water into the container.

In many cases, the actuator is a pressure sensitive mechanical switch. Typically, the switch is operated by pushing the container against, for example, a lever. The lever, in turn, operates the switch that causes the ice and/or water to be dispensed. A number of dispensers employ multiple actuators, one for ice and another for water, while other dispensers employ a single actuator. Dispensers which employ a single actuator typically require additional control elements that enable a user to select between ice and water dispensing operations. Several manufacturers have converted from mechanical switches to electrical or membrane switches. Functioning in a similar manner, a container is pushed against the membrane switch to initiate the dispensing operation. Still other arrangements employ actuator buttons provided on a control panel of the dispenser. With this arrangement, the user continuously depresses a button to release ice and/or water into the container. In yet another arrangement, sensors are mounted in the dispenser well and function to sense a presence and size of the container. The dispenser automatically begins dispensing ice or water based on the presence of the container and stops dispensing before the container overfills. In this case, the level of liquid or ice dispensed is dependent on the container, and cannot be altered by a consumer based on the amount of liquid or ice desired.

Therefore, despite the existence of refrigerator dispensers in the prior art, there still exists a need for an enhanced refrigerator dispensing system. More specifically, there exists a need for a refrigerator dispensing system and method that allows for a hands-free select-fill event.

SUMMARY OF THE INVENTION

The present invention is directed to a select-fill dispensing system and method. More specifically, a dispenser assembly for selectively releasing a fluid product includes a dispenser well provided with a camera. In a preferred embodiment, the dispenser assembly is provided in a household refrigerator, such as for dispensing ice and/or water. The camera provides a means for sensing a desired fill level based on the location of a user's finger with respect to a container within the dispenser well. In use, a consumer places his or her finger along a container within the dispenser well to indicate the desired fill level of the container. Image data from the camera is transmitted to a controller and processed for distortion correction, and edge based image segmentation and morphological operations are carried out to remove background noise. The processed image data is utilized to detect the presence of the container, as well as the shape of the container, the position of the container opening, and the top and bottom points of the container. For filling the container, a user positions his or her finger at a selected fill point on the container, with image data being used to detect the top point of a user's finger adjacent the container. The controller then regulates the dispensing operation based on the desired fill level and the shape of the container. In a preferred embodiment, the controller actually regulates the rate of product dispensing based on the shape and size of the container to optimizing the fill rate of the container, while preventing overflow events.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
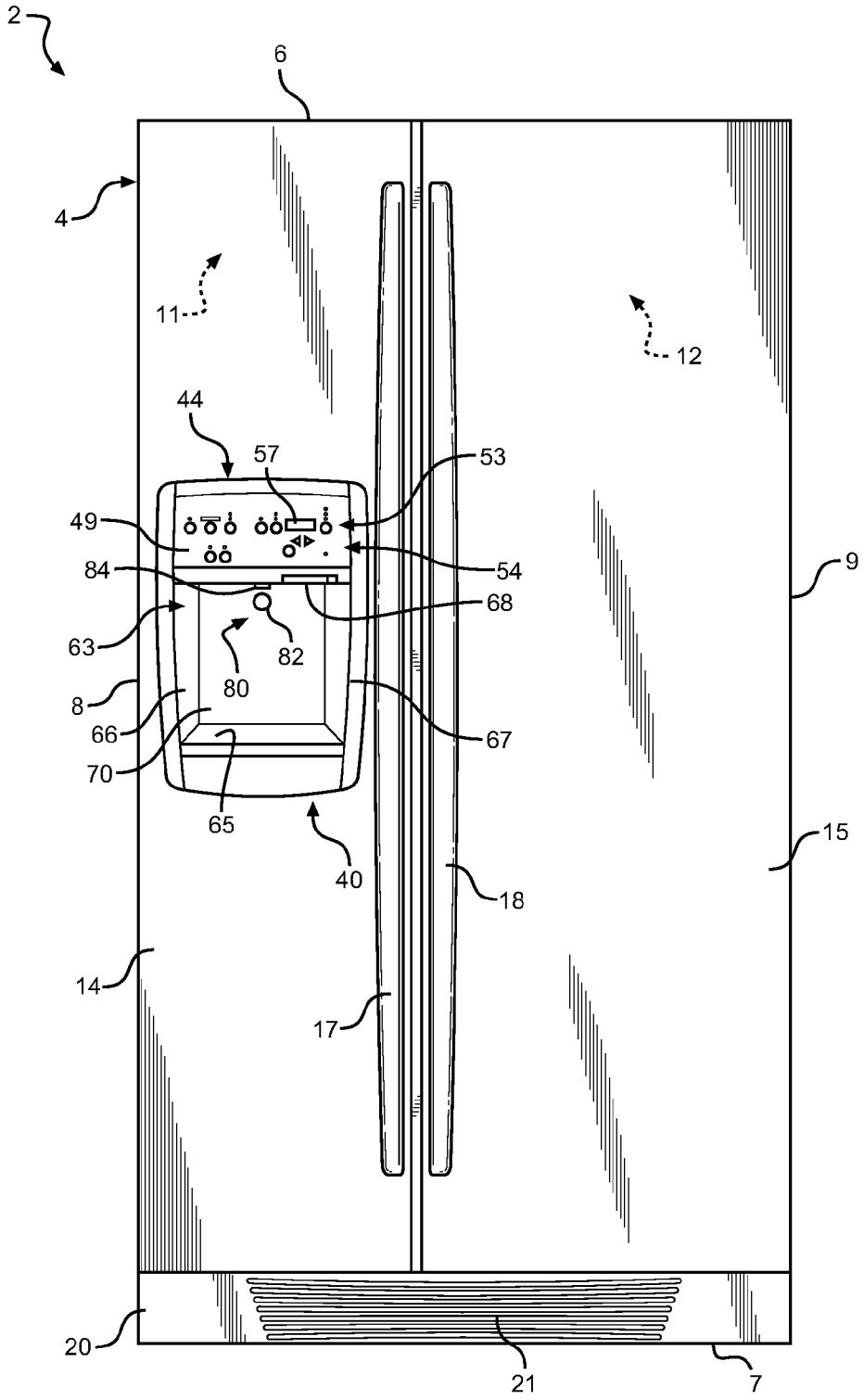
FIG. 1 is a front view of a refrigerator incorporating a select-fill dispensing system in accordance with the present invention.

With initial reference to FIG. 1, a refrigerator constructed in accordance with the present invention is generally indicated at 2. Refrigerator 2 includes a cabinet 4 having a top wall 6, a bottom 7 and opposing side walls 8 and 9. In a manner known in the art, refrigerator 2 includes a freezer compartment 11 arranged alongside a fresh food compartment 12. Freezer compartment 11 includes a corresponding freezer compartment door 14 and fresh food compartment 12 includes a corresponding fresh food compartment door 15. In a manner also known in the art, each door 14 and 15 includes an associated handle 17 and 18. Refrigerator 2 is also shown to include a kick plate 20 arranged at a bottom portion thereof having a vent 21 that permits air to flow to refrigeration components (not shown) that establish and maintain desired temperatures in freezer compartment 11 and fresh food compartment 12. In the embodiment shown, refrigerator 2 constitutes a side-by-side model. However, it should be understood that the present invention could also be employed in connection with a wide variety of refrigerators, including top mount, bottom mount, and French-style refrigerator models. In general, the style of refrigerator depicted is for illustrative purposes only.

In accordance with a preferred embodiment of the invention, refrigerator 2 includes a dispenser assembly 40 having a main housing 44 and a control panel 49. Control panel 49 preferably includes first and second rows of control buttons 53 and 54 which enable a user to select various program parameters and operations. Further, control panel 49 preferably includes a display 57 which, in addition to functioning in cooperation with dispenser assembly 40, enables the user to select particular operational parameters for refrigerator 2, such as desired temperatures for freezer compartment 11 and fresh food compartment 12. Additionally, dispenser 40 includes a dispenser well 63 having a base or container support portion 65, recessed, opposing wall sections 66 and 67, a top wall section 68 and a back wall section 70.

Figure 2:
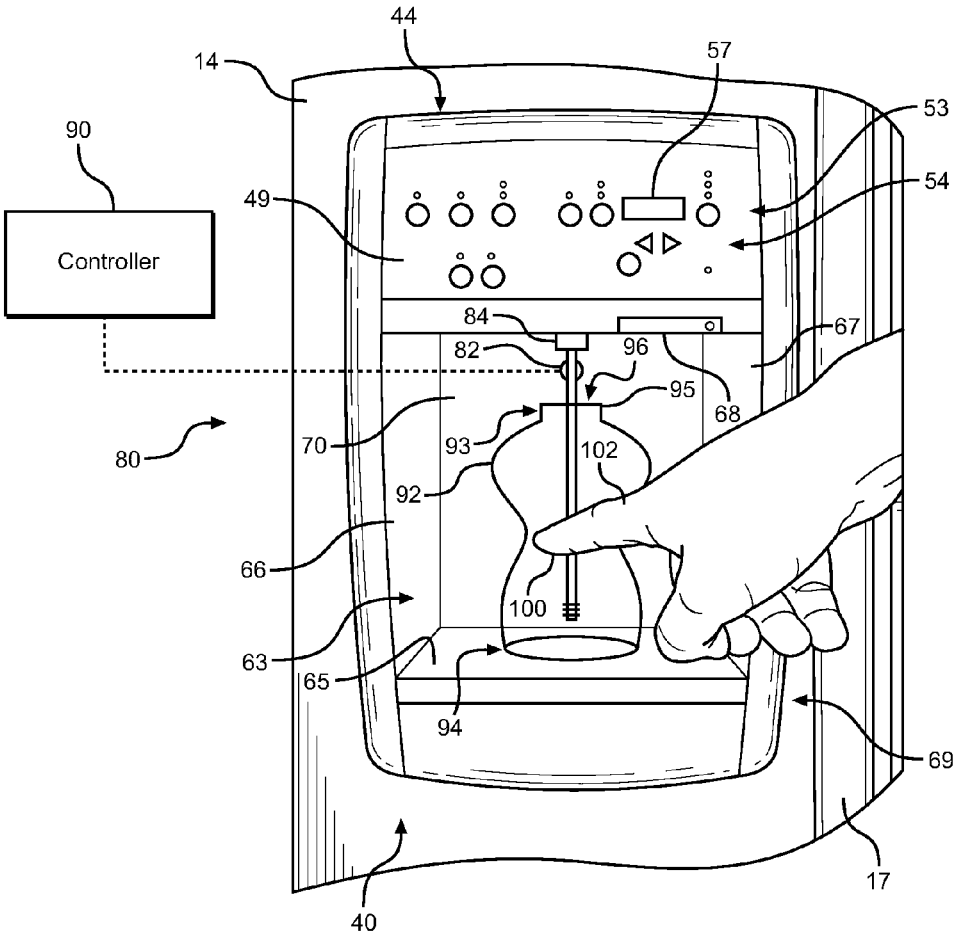
FIG. 2 is an enlarged view of the dispenser of FIG. 1 illustrating the beginning of a dispensing operation in accordance with the present invention.

Turning to FIG. 2, in accordance with the invention, dispenser assembly 40 includes an optical sensing system generally indicated at 80, which includes a camera 82 located within dispenser well 63. Camera 82 is in communication with a controller 90, which regulates the dispensing of water from a spout 84 or ice from a chute (not shown) into a container 92, as will be discussed in more detail below. Although depicted on upstanding wall section 70, it should be understood that camera 82 may be located anywhere within dispenser well 63, so long as camera 82 is positioned to monitor the height of liquid or ice within container 92. The height of container 92 is defined using top and bottom points or planes 93 and 94 of container 92.

The manner in which optical sensing system 80 is utilized will now be discussed with reference to FIGS. 2 and 3. In use, image data from camera 82 is transmitted to controller 90 for image processing. More specifically, an image processing algorithm is utilized by controller 90 to determine the dimensions of container 92 placed within dispenser well 63. Additionally, image data from camera 82 is utilized to detect a desired fill height within container 92. In use, a consumer utilizes a finger or other indicating object 100 to point to the desired fill level on a side of container 92. Camera 82 captures this image and the image data is processed by an image processing algorithm, whereby controller 90 determines the desired fill height in container 92 and controls dispensing of a water product into container 92 to obtain the desired fill level as detailed further below.

Figure 3:
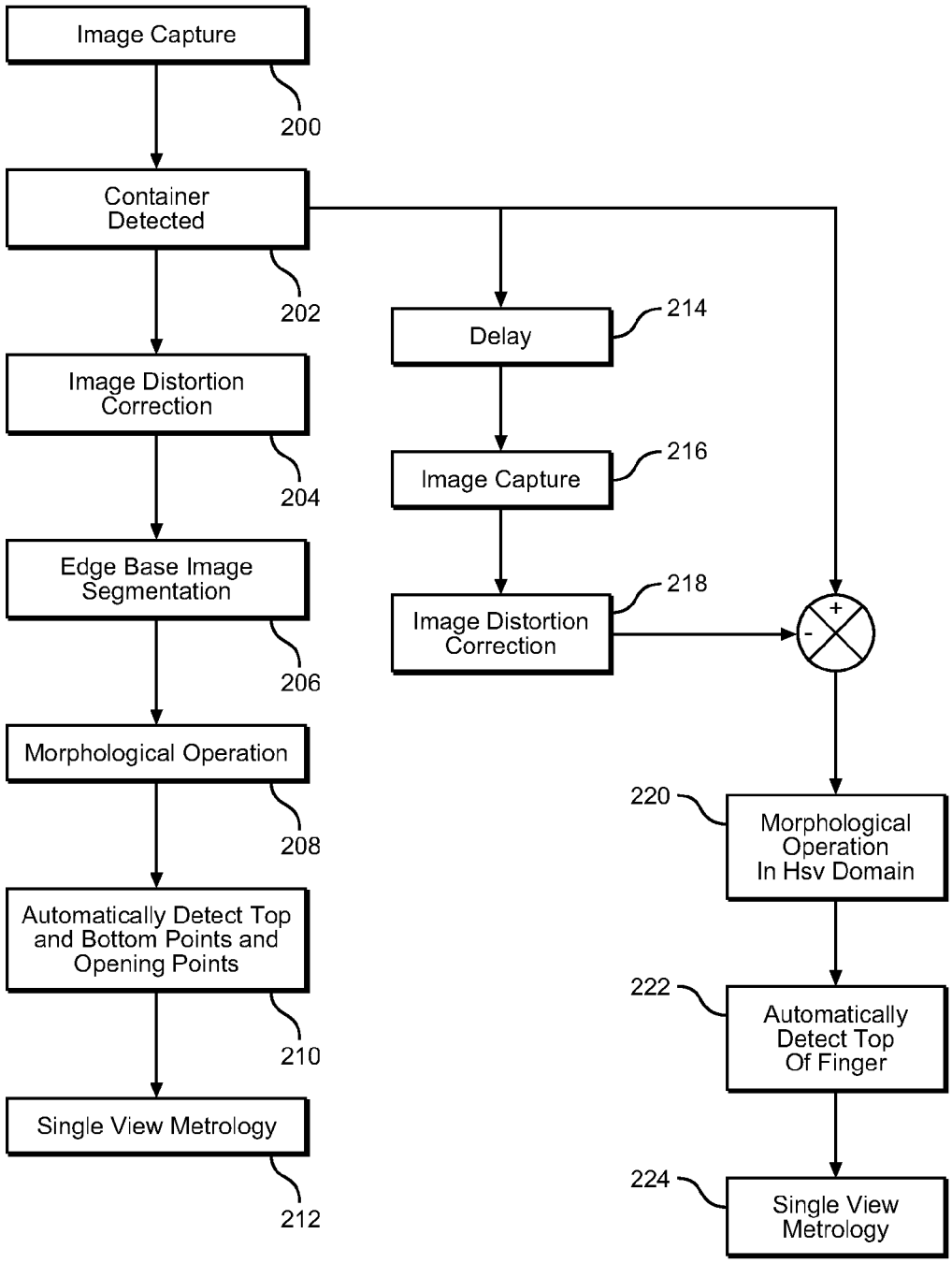
FIG. 3 is a flow chart depicting a method of utilizing the select-fill dispensing system of the present invention.

The method of selecting the height of a water product within a container 92 is outlined in FIG. 3. Image data is captured by camera 82 and transmitted to controller 90 at step 200. In a preferred embodiment, the presence of container 92 within dispenser well 63 is initially sensed by optical sensing system 80 based on image data from camera 82 transmitted to controller 90, as indicated at 202. Controller 90 is able to distinguish between the presence of container 92 in dispenser well 63 and the presence of another object, such as a user's hand. More specifically, in accordance with a preferred embodiment, camera 82 includes a lens which causes fish-eye distortion of images. When this is the case, an image segmentation algorithm within controller 90 is used to correct any image distortion problem as indicated at 204. Once the image is free from distortion, controller 90 separates the image of container 92 from any background image using an edge based image segmentation algorithm at 206. Next, morphological operations are carried out to remove background noise and to determine top and bottom points 93 and 94 of container 92, as indicated at 208. The container image thus separated from the background is used to pinpoint the top and bottom points 93 and 94 of container 92 for automatic height calculation and to calculate the end points 95 defining the container opening 96 at 210. These points 93, 94 and 95 are then mapped to real world dimensions using a single view metrology algorithm at 212.

A brief delay exists between the first set of image data associated with the detection of container 92 and the second set of image data associated with the consumer's finger or indicating object 100, as indicated at 214. Similar to step 204, this second set of image data, as indicated at 216, is processed by the image segmentation algorithm within controller 90 at step 218 to correct any image distortion problems, if necessary. If the existence of the consumer's finger or other indicating object 100 is sensed by optical sensing system 80 based on the processed image data, then morphological operations are carried out at 220 to remove background noise and automatically detect a top portion 102 of the consumer's finger or indicating object 100, as depicted at 222. This top point 102 is then mapped to real world dimensions using a single view metrology algorithm at 224. It should be understood that controller 90 distinguishes between objects within a predetermined distance from container 92 and objects located outside of a predetermined distance from container 92. In this way, a user's finger adjacent container 92 will be recognized as a user indicating a desired fill level for container 92.

Figure 4:
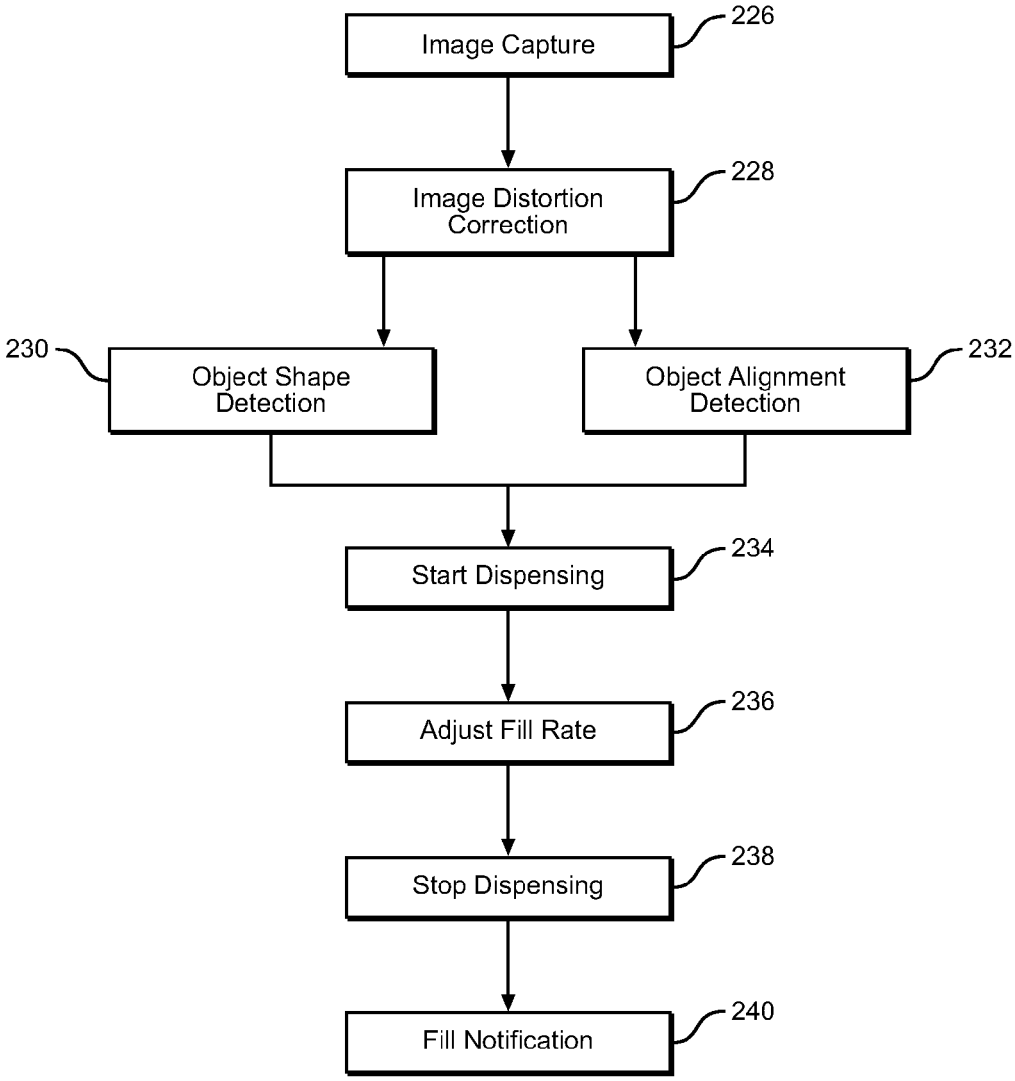
FIG. 4 is a flow chart depicting optional fill steps of the present invention.

Next, controller 90 regulates dispensing of ice and/or water from dispenser assembly 40 based on the data points obtained by optical sensing system 80. In one embodiment, shape recognition software is also utilized to further control dispensing of ice and/or water from dispenser assembly 40. More specifically, after image data is captured and processed as indicated at 226 and 228 in FIG. 4, shape recognition software within controller 90 determines the shape of an object within dispenser well 63, particularly the shape of container 92, as depicted in step 230. Additionally, image data from camera 82 is utilized by controller 90 to determine alignment of opening 96 of container 92 with spout 84 or the ice dispensing chute (not shown), as indicated at 232. If the container is present and properly aligned, controller 90 allows for water or ice to be dispensed from dispenser assembly 40 at step 234.

Optionally, image data continuously processed by controller 90 during the filling operation is utilized by controller 90 to detect the fill rate of container 92 and control the speed of water or ice dispensing based, at least in part, on the change in height of product introduced into container 92, the top and bottom points 93 and 94 of container 92, and the shape of container 92, as indicated at step 236. More specifically, controller 90 is preferably utilized to adjust the speed at which liquid and/or ice is dispensed into container 92 based on how quickly the liquid or ice level increases within container 92. Thus, for a narrower container, fluid is dispensed slower to prevent an over-fill event as compared to fluid dispensed into a larger container, which fills up more slowly. Once a desired fluid or ice level is obtained, controller 90 terminates the dispensing event at step 238. In addition, the filling operation can initially proceed at a faster rate and then be slowed down as the actual fill level approaches the selected fill level. Further, notifications of various conditions may be communicated to a user through indicators (not shown) on control panel 49, or in the form of sounds, such as beeps or buzzes, etc. For example, control panel 49 may initiate a beep or other sound effect when a fill event is complete, as indicated at step 240.

Although described with reference to preferred embodiments of the invention, it should be readily understood that various changes and/or modifications can be made to the invention without departing from the spirit thereof. For example, although mainly depicted and described in connection with a household refrigerator, the dispensing assembly of the invention may be utilized in other types of dispensers, such as a water cooler. In general, the invention is only intended to be limited by the scope of the following claims.

We claim:

1. A refrigerator comprising:

a cabinet;

at least one refrigerated compartment arranged within the cabinet;

a door mounted to the cabinet for selectively providing access to the at least one refrigerated compartment; and a dispenser assembly for selectively releasing at least one of a liquid and ice into a container during a dispensing operation, said dispenser assembly including:

a dispenser well including a base section and an upstanding wall section;

a controller for regulating the dispensing operation of the dispenser assembly; and an optical sensing system in communication with the controller, the optical sensing system comprising:

a camera exposed to the dispenser well and configured to send image data from the dispenser well to the controller of an indicating object placed in the dispensing well in pointing to a desired fill level for the at least one of the liquid and ice in the container, with the controller regulating the dispensing operation based, at least in part, on the desired fill level.

2. The refrigerator according to claim 1, wherein the controller utilizes image distortion and edge based image segmentation processing of the image data.

3. The refrigerator according to claim 1, wherein the controller is further adapted to determine a shape of the container based on the image data and control the dispensing operation based, at least in part, on the shape of the container.

4. The refrigerator according to claim 1, wherein the image data is employed to sense a consumer's finger as the indicating object.

5. A dispenser assembly for selectively releasing at least one of a liquid and ice into a container during a dispensing operation, said dispenser assembly including:

a dispenser well;

imaging means for sensing image data used to ascertain a desired fill level for the at least one of the liquid and ice in the container; and a controller for regulating the dispensing operation of the dispenser assembly based, at least in part, on the desired fill level, wherein the controller for regulating the dispensing operation utilizes image distortion and edge based image segmentation processing of image data.

6. The dispenser assembly according to claim 5, wherein the dispenser assembly further comprises means for detecting a shape of the container.

7. The dispenser assembly according to claim 5, wherein the imaging means comprises an optical sensing system including a camera exposed to the dispenser well and adapted to send image data from the dispenser well to the controller.

8. A method of dispensing a product into a container positioned within a dispenser well of a dispenser assembly, the method comprising:

selecting a desired fill level for the container by introducing an indicating object into the dispensing well;

utilizing image data obtained from a camera exposed to the dispenser well to detect a presence of the indicating object and ascertaining with the image data the desired fill level for a dispensing event;

initiating the dispensing event to dispense the product into the container;

utilizing image data from the camera to monitor a height of the product within the container during the dispensing event; and terminating the dispensing event when the height of the product within the container reaches the desired fill level.

9. The method of claim 8, further comprising: determining a top point of the indicating object based on the image data to determine the desired fill level.

10. The method of claim 8, further comprising:

mapping dimensions of the indicating object based, at least in part, by a top point of the indicating object.

11. The method of claim 8, further comprising: detecting alignment of an opening of the container within the dispenser well based on the image data.

12. A method of dispensing a product into a container positioned within a dispenser well of a dispenser assembly, the method comprising:

selecting a desired fill level for the container by introducing an indicating object into the dispensing well;

utilizing image data obtained from a camera exposed to the dispenser well to detect a presence of the indicating object and ascertaining with the image data the desired fill level for a dispensing event;

initiating the dispensing event to dispense the product into the container;

transmitting a first set of image data from the camera mounted in the dispenser well to a controller;

detecting a presence of the container within the dispenser well; and initiating the dispensing event only after the presence of the container is detected.

13. The method of claim 12, further comprising: determining top and bottom points on the container based on the first set of image data received from the camera.

14. The method of claim 13, further comprising:

processing the first set of image data to separate a container image from any background images to obtain processed image data, wherein the top and bottom points on the container are determined based on the processed image data.

15. The method of claim 14, further comprising:

mapping dimensions of the container based, at least in part, by the top and bottom points of the container.

16. The method of claim 15, further comprising:

determining container opening edge points based on the processed image data, wherein the mapping dimensions of the container are based, at least in part, by the container opening edge points.

17. The method of claim 12, further comprising: transmitting a second set of image data from the camera to the controller, wherein the presence of the indicating object is determined based on the second set of image data.

18. A method of dispensing a product into a container positioned within a dispenser well of a dispenser assembly, the method comprising:

selecting a desired fill level for the container by introducing an indicating object into the dispensing well, wherein the indicating object is a user's finger;

utilizing image data obtained from a camera exposed to the dispenser well to detect a presence of the indicating object and ascertaining with the image data the desired fill level for a dispensing event; and initiating the dispensing event to dispense the product into the container.

* * * * *